United States Patent [19]

Rousseau

[11] 4,426,273

[45] Jan. 17, 1984

[54] WORKHOLDER AND CARRIER FOR ELECTRODEPOSITION SYSTEM

[75] Inventor: Valerie M. Rousseau, Dudley, Mass.

[73] Assignee: Wright Line Inc., Worcester, Mass.

[21] Appl. No.: 289,937

[22] Filed: Aug. 4, 1981

[51] Int. Cl.[3] ..... C25D 7/00

[52] U.S. Cl. ..... 204/297 W; 204/297 R

[58] Field of Search ..... 204/198, 297 R, 297 W

[56] References Cited

U.S. PATENT DOCUMENTS 2,831,808 4/1958 Esseff et al. ..... 204/297 W 3,972,798 8/1976 Palisin ..... 204/297 W

FOREIGN PATENT DOCUMENTS 614850 12/1948 United Kingdom ..... 204/297 W

*Primary Examiner*—F. Edmundson

*Attorney, Agent, or Firm*—Milton E. Gilbert; Gary E. Ross

[57] ABSTRACT

A workholder for an elecrodeposition system for carrying, with improved electrical communication therewith, items to be painted or otherwise coated, comprising: a carrier; a cane-like structure having a hook, a shank connected to said hook, and a plurality of cross beams connected perpendicularly at their midpoints to said shank and in spaced parallel relation one to another, said structure being suspendable from said carrier by said hook; and means for removably securing said items on said cross beams, said means adapted to contact said items only within a hole in the item. The securing means being a spring clip of formed spring steel which has a proboscis-like distal end adapted for insertion with reversible distortion through the hole in the item, and a proximal end which slideably connects to one of the cross beams, and with spring action is removable therefrom.

15 Claims, 9 Drawing Figures

WORKHOLDER AND CARRIER FOR ELECTRODEPOSITION SYSTEM

BACKGROUND OF THE INVENTION

This invention relates generally to a system for electrodeposition of paint, or other coatings, on articles of manufacture; and more practicably to a workholder for retaining and carrying said articles during the electrodeposition process.

In one type of paint electrodeposition system items to be painted are submerged in each of a succession of tanks or vats containing, for example, cleaning solutions or solvents, surface preparation solutions, and/or paints. As is well known, an electrodeposition system by its very nature requires that while the items proceed through each of the tanks, they must be maintained on a carrier in such fashion that an electrical path is established through the contents of the tank, through the items, through the workholder, and eventually back to the tank contents via an electromotive source. It can be readily understood that it is desirable to maintain good electrically-conductive contact between the items to be painted and the workholder.

Further it is desirable to provide a workholder which permits quick and efficient racking and unracking of the items to be painted from the workholder. Also important is the racking density achievable on the carrier system employed, which should be as dense as practically possible without interfering with the painting or racking and unracking of the items.

Typically the items to be painted are carried on magnetic retainers, or placed on simple open-ended hooks secured, for example, to a carrier with set screws. Disadvantages with the prior art include the less than adequate electrical contact provided under certain adverse conditions, for example, when paint previously deposited upon the retainer or the hook inhibits electrical conduction across the contact area to the item. This at times requires an operator to clean the retainer or hook manually. Further, another disadvantage with magnetic retainers, is that the paint may reduce the magnetic retention resulting in items being dislodged from the retainer during electrodeposition. A disadvantage, when a simple hook is used in conjunction with light items to be painted, is that the items tend to float in the various tanks and therefore the items may be dislodged from the hooks or make inadequate electrical connection with the carrier. A still further disadvantage with the prior art is the degree of scarring produced by such carriers. A scar is any area left unpainted on the workpiece after paint electrodeposition and may be most undesirable for at least aesthetic reasons. Thus the prior art suffers many potential disadvantages.

Therefore, an object of the invention is to provide workholders and carrier for items to be painted in an electrodeposition system which maintain the items securely thereon and provide good electrical contact between the item, the holder and the carrier.

Another object of the invention is to provide a workholder and carrier for such a paint system which minimizes or reduces scarring on the item due to the carrier.

A further object of the invention is to provide a workholder and carrier for such a paint system which enables facilitated racking and unracking of items to be painted from said workholder and further enables high density carrying of items to be painted.

Yet another object of the invention is to provide a versatile, economical workholding system which can accommodate a variety of sizes, shapes and weights of items to be painted.

SUMMARY OF THE INVENTION

These and other objects are met in the present invention which is comprised of the combination of a submersible cage or rack having a top horizontal surface defined by a grid or mesh of metallic rods, said surface supported by a plurality of legs; a cane-like structure having a shank portion and a hanger hook portion conected thereto, said hook portion disposable over the intersection of said rods in said top grid in a hook-like fashion; a plurality of cross beams disposed perpendicular to said shank of said cane-like structure and slideably affixed thereto; and a plurality of spring clips having a proboscis-like distal end and a proximal end removably and slideably secured to said cross-beams; wherein said distal end includes distortable spring means for securing thereon items to be painted or otherwise coated by elecrodeposition. In the disposing of the hook portion over the intersection of said rods, of the spring clip on the cross beams, and of the items on the spring clip, one scrapes or scores the respective other, thereby cleaning the contacting surfaces therebetween and providing improved electrical contact.

BRIEF DESCRIPTION OF THE DRAWINGS

For a fuller understanding of the nature and objects of the present invention, reference should be had to the following detailed description taken in conjunction with the accompanying drawings, in which like reference numerals refer to like features, and wherein.

DESCRIPTION OF THE PREFERRED EMBODIMENT

Figure 1:
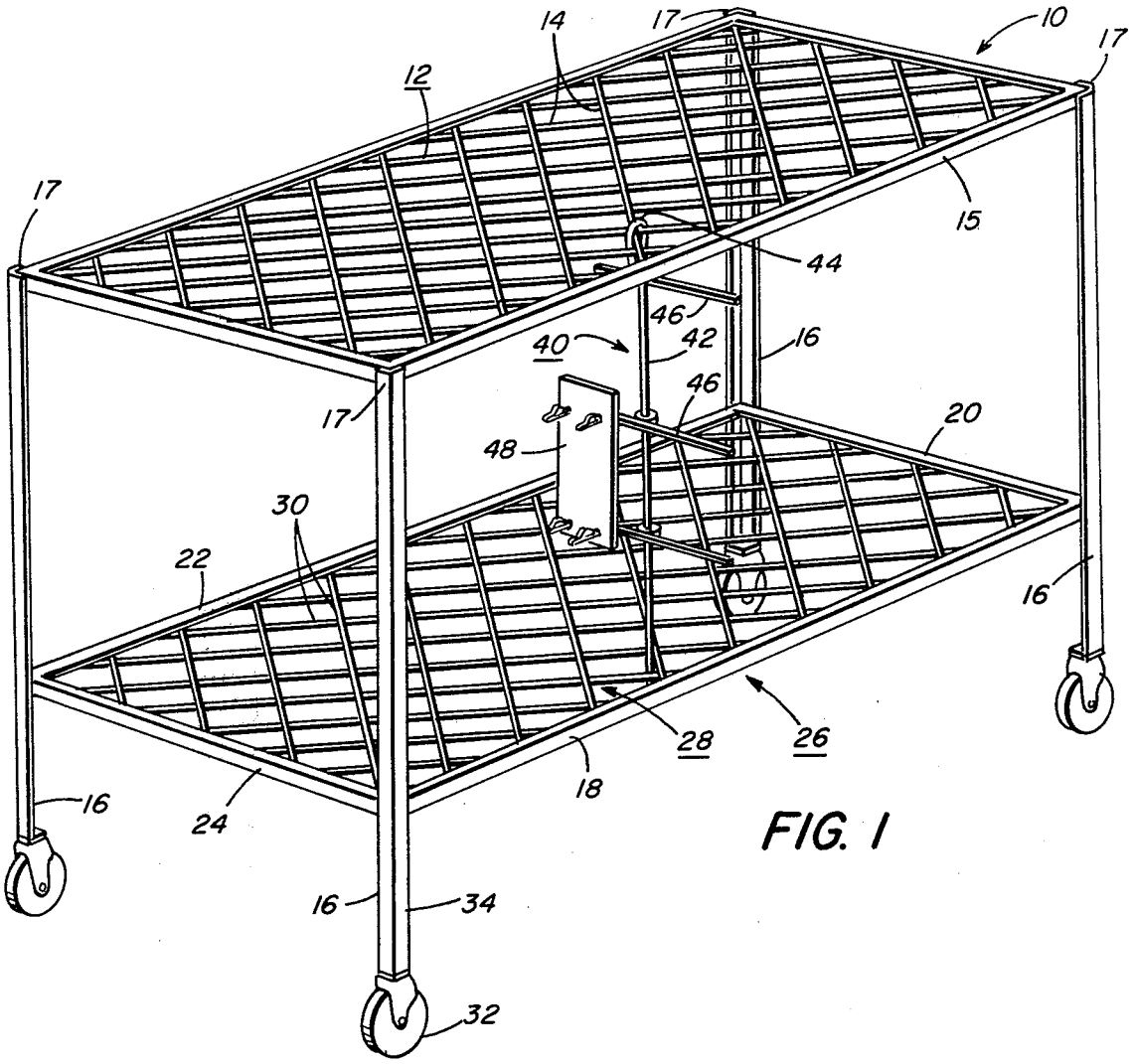
FIG. 1 is a perspective view of the workholder and carrier made in accordance with the invention.

Attention is directed to FIG. 1 in which is shown a submersible cage or rack 10 having a top horizontal surface of a generally rectangular shape defined by a first grid or mesh 12 of metallic rods 14 integrally or separately formed and stamped, woven or laid in a lattice-like fashion within a frame 15. The first grid 12 is supported by a plurality of legs 16 perpendicularly disposed relative to said first grid, fixedly connected to the first frame 15 at its corners 17, and secured in this orientation by bracing members 18, 20, 22 and 24 which together form a rectangular second frame 26 similarly sized, parallel to, and spaced from said first frame 15. According to the preferred embodiment of the invention, the second frame 26, circumscribes and supports a second grid 28 of metallic rods 30, said second grid being similar in size and configuration, and in spaced parallel relation to the first grid 12. Optionally, a plurality of wheels or casters 32 are disposed on the lower end 34 of said legs 16 so as to permit facilitated locomotion of said cage 10.

A cane-like structure 40 of metallic material having a shank portion 42 and a hanger hook portion 44 is suspendable from said first grid 12 by said hook portion. The shank portion 42 should preferably be of sufficient length to extend at least from said first grid 12 to and beyond said second grid 28 but not to or beyond said wheels 32. The second grid 28 maintains the cane-like structure 40 in its vertical orientation as shown, prevents one such structure from contacting another carried in the same rack 10 and yet permits a desired amount of "swinging" of the cane-like structure to obtain better circulation of and contact with the liquids in the tanks (not shown). A plurality of cross beams 46 are disposed perpendicular to said shank portion 42 and in spaced parallel relation one to another, and are preferably slideably connected thereto in a manner hereinafter described. Supported by said cross beams 46 is a metallic item or article of manufacture 48 to be painted or otherwise coated by electrodeposition. Of importance is the manner by which such items 48 are supported, and this shall be the subject of a detailed description below.

In practice, the cage 10 can carry one or more of said cane-like structures 40; each cane-like structure, in turn, carrying one or more items 48. In electrodeposition, the cage 10 is, for example, hoisted up and into a succession of tanks (not shown) as previously described. An electrical path is defined from an electromotive source, through the substantially liquid contents of said tanks, through the item 48, cross beam 46, cane-like structure 40 and by way of the hook portion 44, through the first grid 12 to, for example, cables or wires (not shown), and finally back to the electromotive source. The necessity for such an electrical path as well as the process of electrodeposition are well known in the art and require no illustration or further description herein. Sufficient for the understanding of the present invention is that such an electrical path must be established and maintained even during repeated submersions of the cage 10 and cane-like structure 40 in the various tanks (not shown). The features of the invention have therefore been designed to provide good electrical contact between the item 48, cane 40 and cage 10. Of course each of these must be electrically conductive and therefore, for example, should be of metallic construction.

The present invention is contemplated for use in painting or otherwise coating items 48 preferably of formed sheet metal construction; though it should be readily understood that items of other construction can be accommodated, perhaps with minor modifications to the described invention, which are well within the skill of one in the art having before him this specification.

Figure 2:
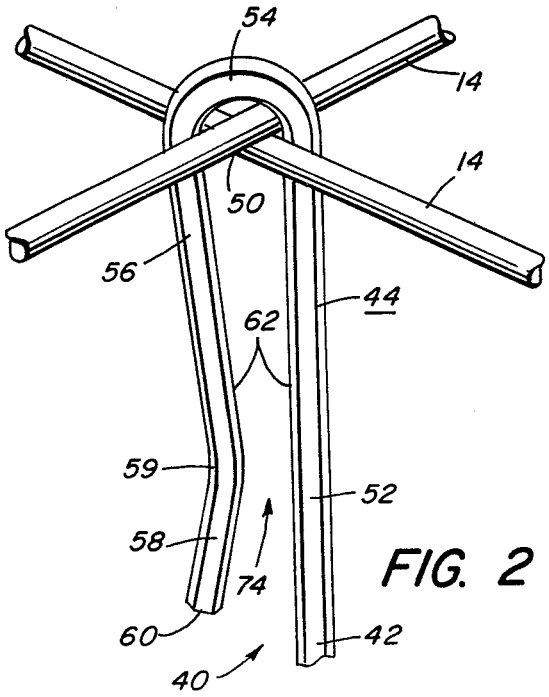
FIG. 2 is an enlarged view in perspective of the hook portion of the crane-like structure shown in FIG. 1.

FIG. 2 is an enlarged view in perspective of the hook portion 44 of the cane 40 shown in hooked relation over the intersection defined by two of the rods 14 in the first grid 12. The hook portion 44 includes a linear element 52 which extends between the shank portion 42 and a curved element 54 which connects the linear element to an intermediate element 56 having at its opposite end a distal element 58. The intermediate element 56 extends in substantial spaced parallel relation to linear element 52 but slightly closer to said linear element at the juncture of the intermediate element and the distal element 58. Likewise, the distal element 58 extends in substantially spaced parallel relation to linear element 52 but, due to bend 59, flares slightly away from said linear element at its end 60. The cane-like structure 40 can be integrally formed of a one-piece rod preferably having a multi-sided, for example hexagonal, cross section (shown best in FIG. 7 at reference numeral 61); said rod being bent without twisting to form the various elements 52, 54 56 and 58. Preferably, after being bent into its final form, one of the apexes 62 of the hexagon 61 lies in spaced confronting or opposing relation with itself on element 52 and 56. An open end 74 of the hook portion 44 is sized to freely permit the manual placement of the hooked portion 44 over the intersection 50. However, an interference fit is effectuated by the narrowing of the opening 74 at bend 59. This provides a rubbing or chafing of the intersection 50 during assembly which is designed to clean said intersection of any unwanted surface buildup that may interfere or reduce with the electrical contact between the intersection 50 and the hook portion 44. The actual electrical contact, after assembly, is provided between the rod 14 and the area of the hook portion 44 generally defined by the curved element 54 along or near one of the apexes 62. In other words, the concave hook portion 44 has an internal dimension at its narrowest point which is approximately equal or slightly less than the width of the intersection 50 of the rods 14 in the first grid 12. In assembly, therefore, the hook portion 44 is slideable over the intersection 50 with a slight scraping action along or near one of said apexes 62 due to said interference fit which cleans the contacting surfaces and permits better electrical connection. Alternatively, it has been found from practical experience that where the hook portion 44 is not submerged in the tank (not shown) good electrical contact can be maintained by its weight when racked with items 48, and, therefore, the interference fit is not necessary.

Figure 3:
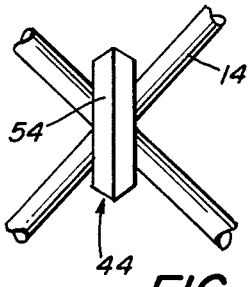
FIG. 3 is a top view of the hook portion shown in FIG. 2.

FIG. 3 is a top view of the assembly shown in FIG. 2 showing another one of said apexes 62 on the curved element 54 of the hook portion 44 and the rods 14.

Figure 4:
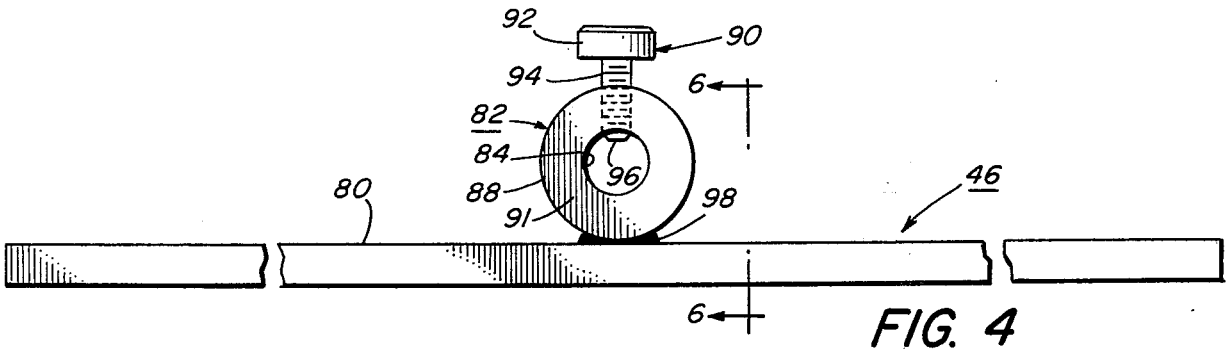
FIG. 4 is a top view of a cross beam according to one embodiment of the invention.
Figure 5:
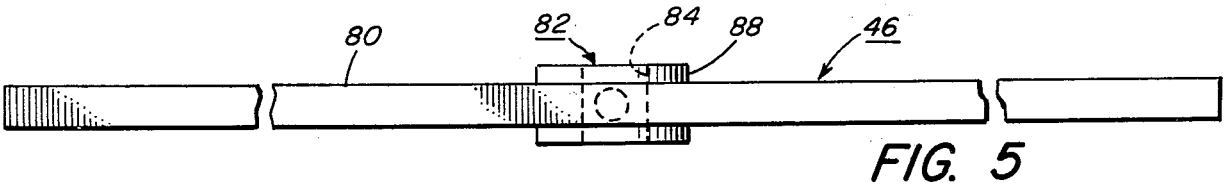
FIG. 5 is a bottom view of the cross beam of FIG. 4 with the bolt removed.
Figure 6:
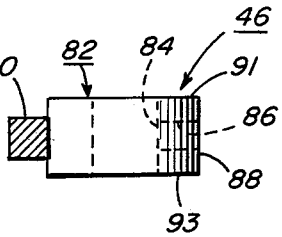
FIG. 6 is a sectional view taken along line 6—6 of FIG. 4.

FIGS. 4, 5 and 6 depict one of the cross beams 46. As shown it comprises a shaft or rod 80 preferably of square or rectangular cross section, for reasons which shall hereinafter be made clear, a nut 82 of cylindrical or annular construction having a central axial bore 84 and a radial bore 86 which extends from the axial bore 84 to and through the nut's outer wall 88. The axial bore 84 is sized to receive in clearance fit the shank portion 42 of the cane-like structure 40. The radial bore 86 is threaded so as to receive in threaded engagement therewith a bolt 90 having a head portion 92 and a shank portion 94. In assembly the shank portion 42 of the cane-like structure 40 is slid through the axial bore 84 to a desired position along its axial extent at which position the bolt 90 is tightened so that the end 96 of the bolt shank 94 firmly contacts said shank portion 42 with sufficient pressure so as to prevent undesired movement of the cross beam 46 relative to the shank portion 42. Preferably the nut 82 is fixedly connected to the rod 80 by any suitable means, for example, by welding which typically would result in the fillets 96 shown in FIG. 4. The nut 82 can be affixed to said rod 80 along the outer surface 88 of said nut, for example as shown, on the radially opposite side of the nut from the radial bore 86, or in any other desired orientation which does not inhibit the operation of said cross beam 46, for example on planar surfaces 91 and 93 of the nut 82.

Figure 7:
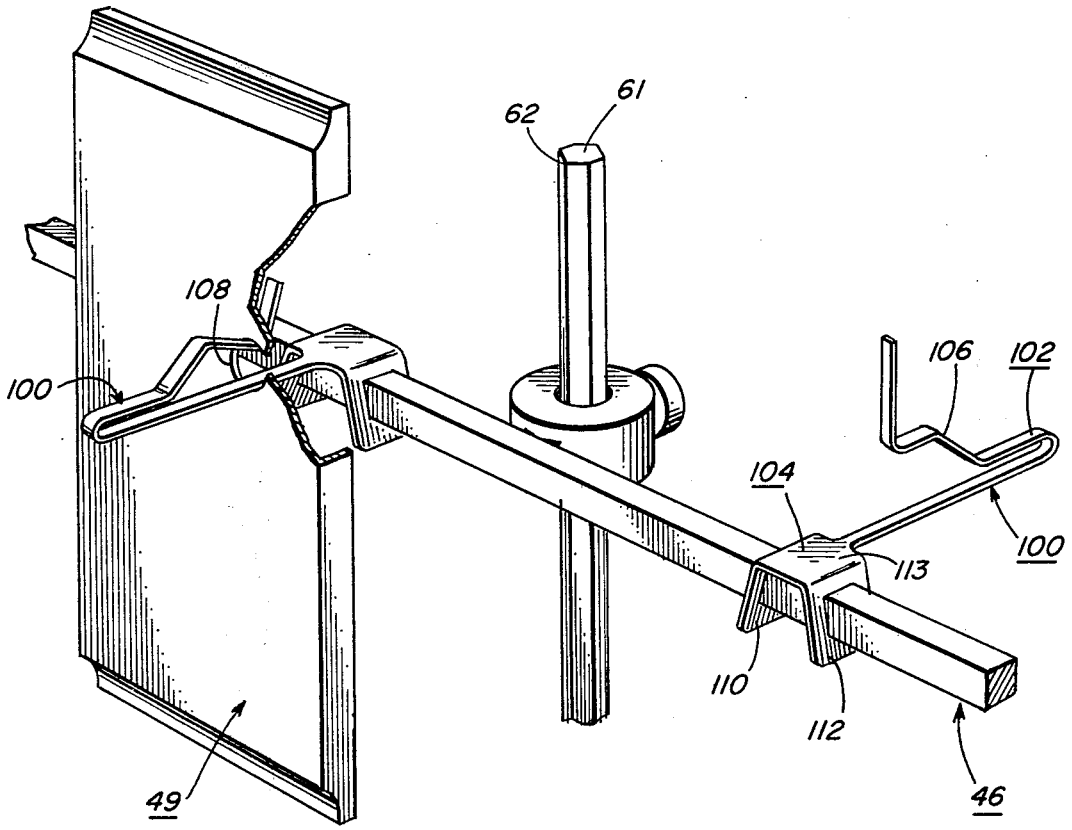
FIG. 7 is a partial perspective view, partially broken away, of a cane, a cross beam, and spring clips made in accordance with an embodiment of the invention, shown as supporting an item to be painted.

FIG. 7 is a partial perspective view of the shank portion 42, the cross beam 46, an item 49 (a smaller one than the item 48 shown in FIG. 1) and a plurality of spring clips with each identified by the reference numeral 100. The spring clip 100 has a proboscis-like distal end 102 and a posterior end 104 removably and slideably secured to the cross beam 46. The distal end 102 includes a distortable spring means 106 for securing an item such as items 48 or 49 onto the cross beam 46. The distal end 102 of the spring clip 100 is designed to extend through a hole 108 in item 49. The hole 108 must be sized so as to provide an interference fit with the distal end 102 when it is inserted therein. The spring means 106 distorts upon insertion into hole 108 in such a fashion that the restorative force of the spring means 106 acts to apply a pressure on the inside walls of the hole 108 during and after insertion which results in a scraping of the contacting surfaces of the hole 108 and the distal end 102 which cleans these surfaces so as to provide better electrical connection therebetween. Further, the restorative force of the spring means 106 acts to hold and maintain the item 48 thereon as well as maintain sound electrical contact between the item and the spring clip 100. Thus it can be readily understood and appreciated that the only contact between the workholder and the item of manufacture is within the hole in the item and thus scarring, especially onto surfaces of the item, is minimized.

Figure 9:
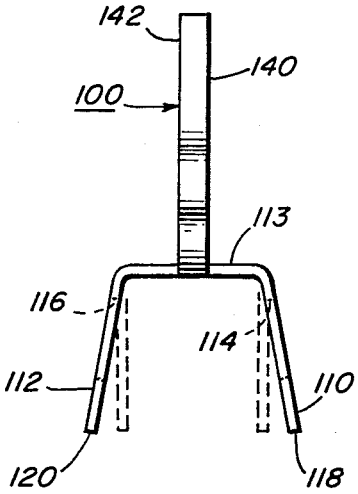
FIG. 9 is a right side view of the spring clip shown in FIG. 8.
Figure 8:
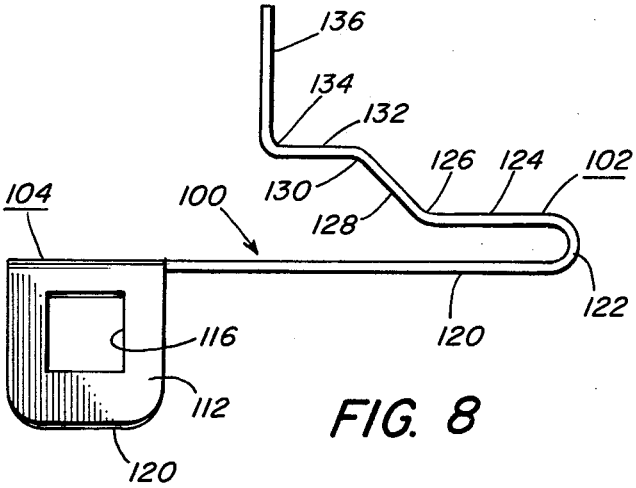
FIG. 8 is a side view of the spring clip made in accordance with the invention.

The spring clip 100 is secured to the cross beam 46 in a manner so as to insure improved electrical connection. This is achieved through the configuration and orientation of the posterior end 104 of the clip 100 which is comprised of two tabs 110 and 112 orthogonally connected to a connecting surface 113 so as to form a "U" shape therewith. Reference should now be had to FIGS. 8 and 9. The two tabs 110 and 112 are disposed in spaced parallel relation one to the other with aligned holes 114 and 116, respectively, therein shaped and sized so as to receive the cross beam 46 axially therethrough. In the preferred embodiment the holes 114 and 116 are of a substantially rectangular configuration similar to the cross section of the cross beam 46. The holes 114 and 116 may, for example, be stamped cutouts in the tabs 110 and 112. The size of the holes 114 and 116 should each provide for a clearance fit when the cross beam 46 is inserted through each. (A clearance fit imports that the holes 114 and 116 are approximately equal to though slightly larger than the cross section, appropriately oriented, of a cross beam 46 so as to have no actual interference of material when the parts are mated. This is in contradistinction to an interference fit in which, as the name implies an internal member is slightly larger than an external member, such that actual interference results.) As stated above the tabs 110 and 112 are substantially normal to the connecting surface 113 but, in the preferred embodiment the tabs, slightly flare outwardly relative to one another toward their more distal ends 118 and 120, respectively. Each may, for example, flare approximately 10°–15° from the normal relative to the connecting surface 113. This is shown most clearly in the solid lines in FIG. 9. By this slight flare assembly of the clips 100 onto the cross beam 46 requires the tabs 110 and 112 to be manually pressed into a normal position shown in phantom lines in FIG. 9 so to permit the cross beam 46 to pass through the holes 114 and 116 with said clearance fit. When the tabs are released they return by their own resiliency to their original flared position and grip the cross beam 46. In other words the two tabs 110 and 112 act as leaf springs and, though each tab by itself would permit a clearance fit with a cross beam 46, their combination in conjunction with their relative orientation, i.e., the slight flaring, produces a snug fit on the cross beam after manual assembly. The restorative pressure of these so-called leaf springs provides the necessary contact pressure to obtain better electrical contact.

Removal of the spring clip 100 from the cross beam 46 is effectuated by simply manually squeezing the tabs 110 and 112 toward one another until they are each normal to the connecting surface 113 and then sliding the spring clip off the cross beam.

Preferably the cross beam 46 is of a square cross-section in which case the posterior end 104 has square holes 114 and 116 sized to mate with the cross beam in the manner explained herein. The spring clips 100 orientation on the cross beam 46 can therefore be in one of four directions, horizontally forward or rearward (both are shown in FIG. 7) or vertically towards or away from the hook portion 44 of the cane-like structure 40.

The distal end 102 of the spring clip 100 is "U" shaped and adapted to provide a facilitated lead-in into the hole 108 and the spring or resilient qualities necessary to maintain the item 49 thereon with good or improved electrical connection. The distal end 102 includes a first horizontal strip 120 which extends perpendicular after assembly to both the cross beam 46 and the shank portion 42 of the cane 40 (see FIG. 7) and ends in a radiused nose 122 which connects that first horizontal strip to a second horizontal strip 124 disposed substantially parallel to the first strip and extending back towards the posterior end 104 of the clip 100 for a distance approximately one-third of the length of said first strip 120. The second horizontal strip culminates in a bend 126 away from said first strip 120 which connects said second strip 124 to an inclined strip 128 which, in turn, ends in a second bend 130 connecting said inclined strip to a third horizontal strip 132 disposed substantially parallel to said first and second horizontal strips 120 and 124 and extending back towards the posterior end 104 of the clip by a distance approximately one-third the length of said first horizontal strip. The third horizontal strip 132 culminates in a 90° bend 134 connecting said strip to a vertical strip 136 which extends substantially perpendicular to and away from said first horizontal strip 120 and in spaced relation thereto. The nose 122 and the inclined strip 128 provide the lead-in for facilitated insertion into hole 108. The configuration is designed to distort in resilient fashion to maintain the item thereon with good electrical connection.

As stated, an item to be painted is provided with at least one hole 108 sized so as to accommodate the distal end 102 of said clip 100 in a lengthwise direction. The diameter of said hole 108 should be approximately equal to the total or sum of (a) the distance from the first horizontal strip 120 to said second horizontal strip 124 plus, (b) one-half to two-thirds the distance between the second horizontal strip 124 and the third horizontal strip 132, plus the material thickness of strip 120.

During assembly, when the spring clip 100 is inserted through a hole 108 in the item 49 (in FIG. 7) to be painted, the clip deforms with edges 140 and 142 of the clip scoring or otherwise scraping the edges of the hole 108 in the item 49 and thereby providing the desired electrical contact. The item 49 after assembly is longitudinally disposed along said distal end 102 in the region of said 90° bend 134. Removal of the item 49 from the spring clip 100 is effectuated by simply manually squeezing the distal end 102 and pulling the item off.

Throughout, it is anticipated that the item 49 (in FIG. 7) to be painted is of a formed sheet metal construction of approximately one-sixteenth to one-eighth of an inch or less in material thickness. The hole 108 can for example, be of a ⅛" to 3/16" diameter. The distance between the first and third horizontal strips, 120 and 132, respectively, measured orthogonally, should be approximately ⅜". For example, the clip 100 can be stamped and formed from treated flat spring steel of 22 gauge. The spring clip 100 is designed for repeated use with minimal maintenance. If the clip 100 is accidentally deformed it can be easily bent back into its proper shape or replaced with minimal effort.

It will be apparent that the invention herein described is susceptible of being practiced otherwise than as herein illustrated. For example, a variety of sizes, shapes and weights of items to be painted can be accommodated by the utilization of a multiplicity of spring clips disposed in an appropriate orientation, for example, on one or more cross beams and inserted through a like multiplicity of holes in the item.

It should now be understood that by this arrangement a workholder and carrier for an electrodeposition system is provided which maintains items to be painted in a secure fashion, with improved electrical contact therebetween. The invention minimizes scarring on the item after painting, while permitting facilitated racking and unracking, and high racking density.

What is claimed is:

1. In combination:

a cage having a top surface including a plurality of metallic rods;

a cane-like structure having a shank portion, and a hook portion connected to said shank portion, said hook portion disposable over at least one of said rods;

a plurality of cross beams disposable perpendicular to said shank portion and connectable thereto; and at least one spring clip having a posterior end connectable to one of said cross beams and a distal end connected to said posterior end, said distal end being in the form of a distortable spring means for securing thereon an article of manufacture.

2. The combination of claim 1 wherein the spring clip, the cross beams, the cane-like structure and the rods are constructed of an electrically conductive material.

3. The combination of claim 1 wherein the cross beam includes a shaft to which said spring clip is connectable; a nut affixed to said shaft, said nut having a bore therethrough sized to slideably receive said shank portion; and means to lock said nut onto said shank portion.

4. The combination of claim 1 wherein the distal end of the spring clip is "U" shaped, and includes: a radiused nose; a first strip connecting a first end of said nose to said proximal end; a second strip in spaced parallel relation to said first strip and connected to a second end of said nose; a third strip parallel to the second strip and disposed at a greater distance from said first strip and closer to the posterior end than is said second strip; an inclined strip connected between the second and third strips; and a fourth strip connected at one of its ends to said third strip and substantially perpendicular thereto.

5. The combination of claims 1, 3 or 4 wherein the posterior end of said spring clip includes first and second tabs and a planar strip connecting said first and second tabs, the tabs having therethrough openings substantially in alignment with one another.

6. The combination of claim 5 wherein the cutouts in the tabs are configured and sized so as to achieve in combination an interference fit with the cross beam when the latter is inserted therethrough.

7. The combination of claim 5 wherein the tabs are disposed at an angle approximately 10°–15° from the perpendicular relative to the planar strip.

8. The combination of claim 6 wherein the tabs are connected to the planar strip at a first end, and flare away from one another at a second and opposite end.

9. The combination of claim 1 wherein the rods in the top surface form a grid, and the hook portion is sized and configured to be disposable over the intersection of at least two rods in the grid.

10. A workholder for an electrodeposition system for carrying, with improved electrical communication therewith, items to be painted or otherwise coated, comprising:

a carrier;

a cane-like structure having a hook, shank connected to said hook, and a plurality of cross beams connected perpendicularly at their midpoints to said shank and in spaced parallel relation one to another, said structure being suspendable from said carrier;

means for removably securing said items on said cross beams, said means adapted to contact said items only within one or more holes in said items.

11. The workholder of claim 10 wherein said carrier is a cage, from which and in which said structure is suspended, and said structure is formed from a many-sided metal rod.

12. The workholder of claim 10 wherein the securing means includes a first portion sized and configured to extend through a hole in the item and to hold said item by spring deformation of said first portion; and a second portion including means for removably and slideably connecting said spring clip to said crossbeam.

13. The workholder of claim 1 or 10 wherein the spring clip is of one-piece integral construction.

14. A work-holding device in the form of a spring clip comprising:

(1) a posterior portion including two tabs connected at one of their ends by a planar surface, said tabs each having therethrough a hole sized and configured to receive with clearance fit a supporting member to which the spring clip is to be removably mounted, said tabs being disposed at an angle from the perpendicular relative to the connecting surface, such that the tabs flare away from one another at a first one of their ends, whereby the combination of said flared tabs provides an interference fit when said supporting member is inserted through both of said holes; and (2) a proboscis-like distal portion of a generally "U" shape connected to said posterior end and including a radiused nose; a first strip connecting a first end of said nose to said posterior end; a second strip in spaced parallel relation to said first strip and connected to a second end of said nose; a third strip parallel to the second strip and disposed at a greater distance from said first strip and closer to the posterior portion of said clip than said second strip; an inclined strip connected between the second and third strips; and a fourth strip connected at one of its ends to said third strip and at an angle thereto, wherein the distal portion is adapted for insertion into a hole in an item to be maintained thereon substantially between said inclined strip and said fourth strip; said distal portion being reversibly distortable during insertion in such manner that the inclined strip and the first strip move toward one another, and wherein the item is manually removable from said spring slip which substantially returns to its undistorted configuration after removal of the item.

15. The combination of claim 9 wherein the hook portion, rods, spring clip, and cross beams are adapted, configured and cooperate such that, as the hook portion is being disposed over the intersection of the rods, the spring clip is being disposed on the cross beams, or the item is being disposed on the spring clip, one scrapes or scores the respective other, thereby cleaning the contacting surfaces and improving electrical contact therebetween.

* * * * *